US009088112B1

(12) United States Patent
Davies et al.

(10) Patent No.: US 9,088,112 B1
(45) Date of Patent: Jul. 21, 2015

(54) COUPLING ELECTRONIC RECEPTACLES TO DEVICES

(71) Applicant: Amazon Technologies, Inc., Reno, NV (US)

(72) Inventors: Joshua Paul Davies, Fremont, CA (US); Brandon Michael Potens, Campbell, CA (US); Andrew McIntyre, San Francisco, CA (US); Angel Wilfredo Martinez, Cupertino, CA (US); Kelly Erin Johnson, Menlo Park, CA (US)

(73) Assignee: Amazon Technologies, Inc., Reno, NV (US)

( * ) Notice: Subject to any disclaimer, the term of this patent is extended or adjusted under 35 U.S.C. 154(b) by 169 days.

(21) Appl. No.: 13/793,057

(22) Filed: Mar. 11, 2013

(51) Int. Cl.
*H01R 12/71* (2011.01)

(52) U.S. Cl.
CPC ..... *H01R 12/716* (2013.01)

(58) Field of Classification Search
CPC ..... H01R 13/6658; H01R 12/79; H01R 43/0256; H01R 12/57
USPC ..... 439/59–62, 676
See application file for complete search history.

(56) References Cited

U.S. PATENT DOCUMENTS

| | | | | |
|---|---|---|---|---|
| 4,717,218 | A * | 1/1988 | Ratcliff | 439/59 |
| 6,190,210 | B1 * | 2/2001 | Belopolsky et al. | 439/676 |
| 7,670,150 | B2 * | 3/2010 | Hisamatsu et al. | 439/79 |
| 2008/0057795 | A1 * | 3/2008 | Chen | 439/723 |
| 2013/0178075 | A1 * | 7/2013 | Hsueh | 439/62 |

* cited by examiner

*Primary Examiner* — Truc Nguyen
(74) *Attorney, Agent, or Firm* — Sutherland Asbill & Brennan LLP

(57) ABSTRACT

According to one or more embodiments of the disclosure, a device is provided. The printed circuit board may include an electronic receptacle. Additionally, the printed circuit board may include a housing element housing a portion of the electronic receptacle. As such, the housing element may include a top portion, a bottom portion, and at least one side portion. To this end, the top portion of the housing element may extend above a bottom surface of the printed circuit board, and the bottom portion of the housing element may extend below the bottom surface of the printed circuit board. Moreover, the printed circuit board may include at least one spring connector coupled to the electronic receptacle and the printed circuit board.

20 Claims, 7 Drawing Sheets

COUPLING ELECTRONIC RECEPTACLES TO DEVICES

BACKGROUND

Recent advances in technology have spawned increases in demand for devices having thinner profiles. As such, many electronic components have been reduced in size, and various techniques have been developed for coupling such components to printed circuit boards. Indeed, these techniques can affect the overall thickness/thinness in profile of mobile devices.

BRIEF DESCRIPTION OF THE DRAWINGS

Reference will now be made to the accompanying figures and diagrams, which are not necessarily drawn to scale, and wherein.

DETAILED DESCRIPTION

The present disclosure relates to devices having an electronic receptacle coupled to a device. The device may include a printed circuit board, which may have a top surface and a bottom surface. In addition, the device may also include an electronic receptacle coupled to the printed circuit board using at least one connector pin. In some embodiments, the electronic receptacle may be an audio jack. Additionally, the electronic receptacle may include a housing element that may house at least a portion of the electronic receptacle. As such, the housing element may be coupled to the printed circuit board such that a top portion of the housing element may extend above the top surface of the printed circuit board, and a bottom portion of the housing element may extend below the bottom surface of the printed circuit board. In some embodiments, the connector pin may be a spring contact, or more specifically, a leaf spring contact. Furthermore, the spring contact may extend from a side portion of the housing element to the printed circuit board.

Implementing the techniques discussed above may reduce the thickness in devices. For example, coupling an electronic receptacle to a printed circuit board using one or more of the above embodiments may reduce the "height" to which the electronic receptacle may extend beyond the top surface and/or bottom surface of the printed circuit board. Limiting such "height" may facilitate designs of relatively thinner profile devices that may enable a "cleaner" or more sophisticated aesthetic for the device, thereby enhancing design efficiency or desirability.

Figure 1:
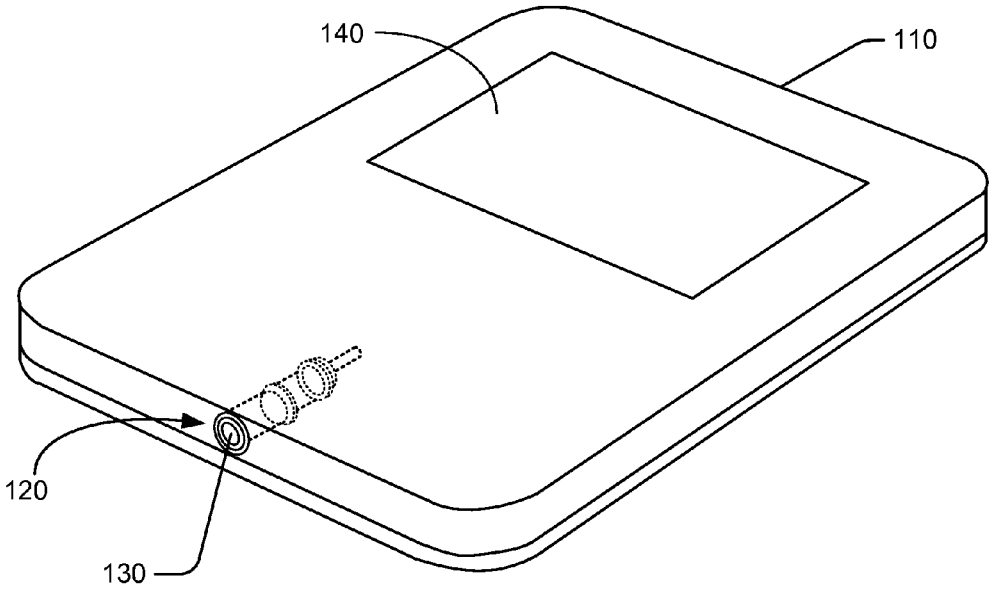
FIG. 1 shows a device including an electronic receptacle according to one or more example embodiments.

The above principles, as well as perhaps others, are now illustrated with reference to FIG. 1, which depicts a device 110. The device 110 may include, but is not limited to smartphones, mobile phones, laptop computer, desktop computer, tablet computers, televisions, set-top boxes, game consoles, in-vehicle computer systems, and so forth. In one embodiment, the device 110 may include a display 140 that may present content to a user (not shown) of the device 110.

In one embodiment, the device 110 may comprise an electronic receptacle 120 that may include, but is not limited to, an audio jack, High-Definition Multimedia Interface (HDMI) jack, Universal Serial Bus (USB) jack, and/or any other type of electronic receptacle or jack. The electronic receptacle 120 may implement a receiving end for an electrical connection between the device 110 and a remote device (not shown). The electrical connection may facilitate electrical communication between the device 110 and the remote device. For example, the electrical communication may include the transfer of data, information, or content between the device 110 and the remote device.

In this embodiment, the electronic receptacle 120 may include an opening 130, which may be used to receive an electronic component (not illustrated), such as an electronic plug, to complete the electrical connection as discussed above.

Figure 2A:
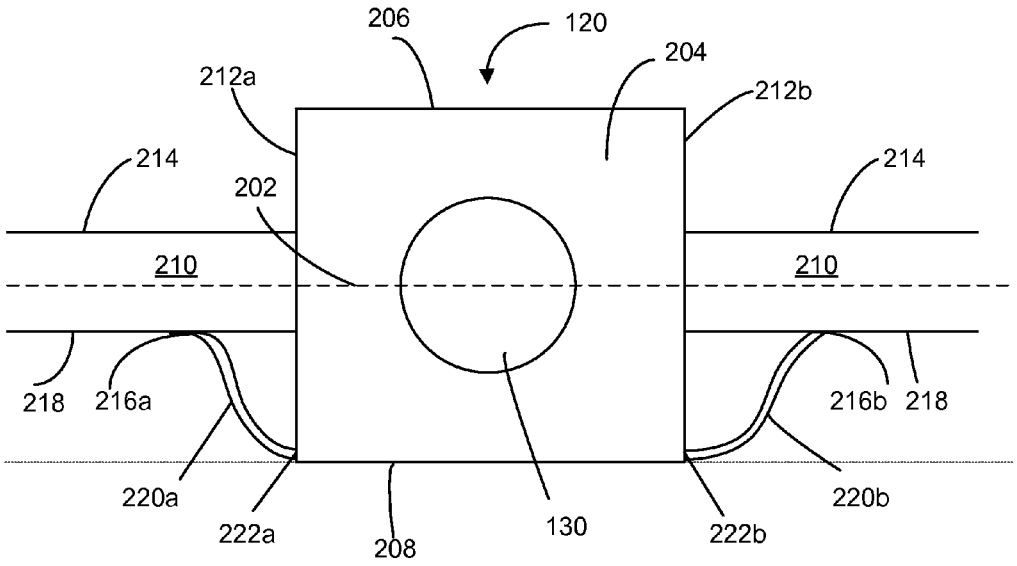
FIG. 2A shows a front-view of an electronic receptacle according to one or more example embodiments.
Figure 2B:
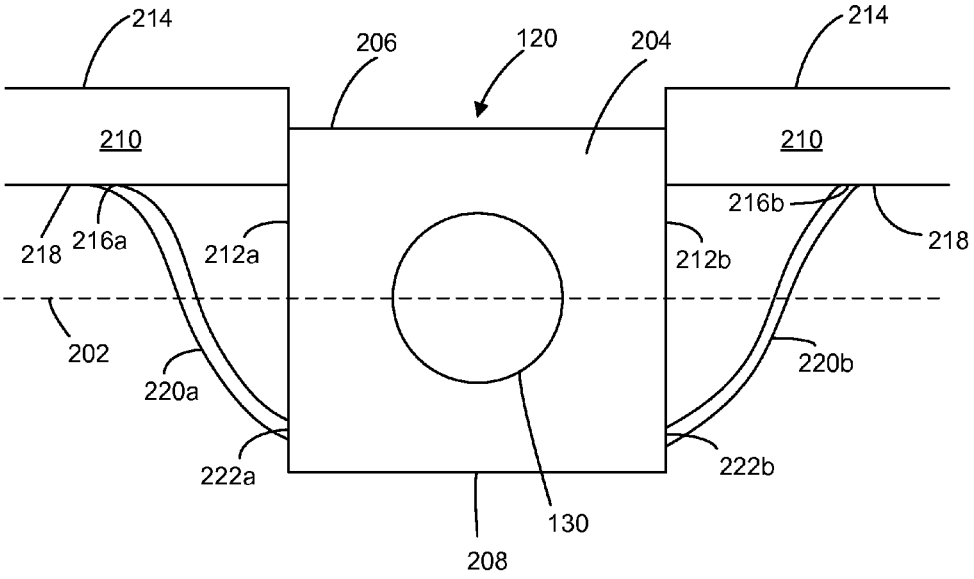
FIG. 2B shows another front-view of an electronic receptacle according to one or more example embodiments.
Figure 2C:
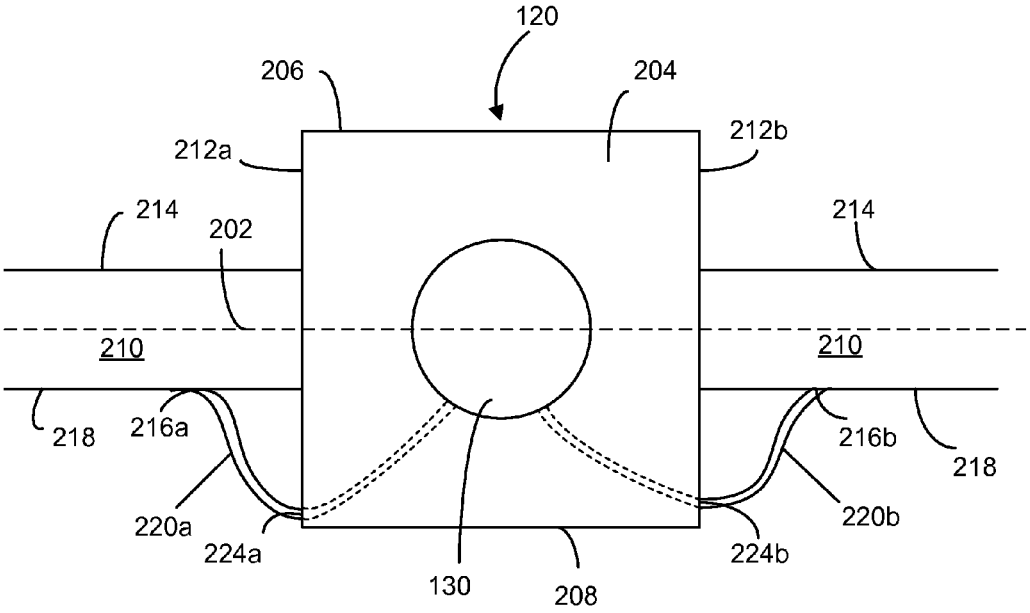
FIG. 2C shows another front-view of an electronic receptacle according to one or more example embodiments.

FIGS. 2A-C illustrate front-view depictions of certain embodiments of the present disclosure. In some embodiments, the depictions may relate to mounting, attaching, or otherwise coupling the electronic receptacle 120 to a substrate 210. In some embodiments, the substrate 210 may include, but is not limited to, a printed circuit board. It should be noted that while references to the substrate 210 as a printed circuit board may be made throughout the disclosure, the substrate 210 may include the device 110 itself, a component of the device 110, a peripheral component coupled to the device 110, and/or generally any other type of component that may be used as a mounting platform for electrical receptacles or electronic components.

According to some embodiments, a housing element 204 may house or surround at least a portion of the electronic receptacle 120 and/or the housing element 204. The housing element 204 of the electronic receptacle 120 may include a top portion 206, a bottom portion 208, and one or more side portions 212*a-b*. To this end, the top portion 206 may include any portion of the housing element 204 above a horizontal axis 202 bisecting the housing element 204. The bottom portion 208 may include any portion of the housing element 204 below the horizontal axis 202. In certain embodiments, the top portion 206 may be the top surface of the housing element 204 while the bottom portion 208 may be the bottom surface of the housing element 204.

Furthermore, while FIG. 2A and subsequent figures may illustrate the housing element 204 as rectangular shaped, it should be understood that the housing element 204 may resemble any other shape or form. For example, the housing element 204 may be cylindrically and/or oblong shaped or may otherwise have rounded surfaces. In such cases, the rounded surfaces may be in cross-section of top edges, bottom edges, and side edges that may correspond to the top portion 206, bottom portion 208, and side portion(s) 212*a-b* described above.

Thus, as illustrated in FIG. 2A, the electronic receptacle 120 may be mid-mounted to the substrate 210. For example, the substrate 210 may include an opening to receive the housing element 204 and/or the electronic receptacle 120. When the housing element 204 is inserted into the substrate 210, the top portion 206 of the housing element 204 may extend above the top surface 214 of the substrate 210. Moreover, the bottom portion 208 of the housing element 204 may extend below the bottom surface 218 of the substrate 210. In some embodiments, mounting the electronic receptacle 120 in such a manner may facilitate designs for relatively thinner/slimmer profile devices 110 by limiting the height or the amount of the housing element 204 that may extend beyond the top surface 214 and/or bottom surface 218 of the substrate 210.

According to certain embodiments, one or more connector pins 220*a-b* may be coupled to the electronic receptacle 120 (and therefore, the housing element 204 as well) and the substrate 210. For instance, the connector pin(s) 220*a-b* may extend from a side portion (e.g., 212*a* or 212*b*) of the housing element 204 to one or more contact points 216*a-b* included on the bottom surface 218 of the substrate 210. As such, the connector pin(s) 220*a-b* and contact points 216*a-b* may facilitate signal and/or electrical communication between the substrate 210 and the electronic receptacle 120. For example, in implementations where the electronic receptacle 120 represents an audio jack, the connector pin(s) 220*a-b* may facilitate audio communication between the audio jack and the substrate 210. Other types of electrical communication may also be communicated depending on the type of electronic receptacle 120.

In some embodiments, the connector pin(s) 220*a-b* may be spring contacts and may be fastened to the side portion(s) 212*a-b* of the housing element 204 via one or more fastening elements 222. The fastening elements 222 may include, but are not limited to, screws, solder, snaps, adhesives, or any other type of fastening elements. According to one or more embodiments, the spring contacts 220-*b* may be loaded such that downward force exerted by the substrate 210 on the spring contacts 220*a-b* may keep the spring contacts 220*a-b* substantially in place and in contact with contact points 216*a-b*. As such, electrical connection(s) may be maintained between the electronic receptacle 120 and the substrate 210.

It should be noted that while FIG. 2A illustrates the connector pin(s) 220*a-b* as extending from the side portion(s) 212*a-b* of the housing element 204 to the bottom surface 218 of the substrate 210, other configurations are also possible. For example, in some embodiments, the connector pin(s) 220*a-b* may extend from the side portion(s) 212*a-b* of the housing element 204 to the top surface 214 of the substrate 210. In other implementations, the connector pin(s) 220*a-b* may also extend from the top portion 206 and/or the bottom portion 208 of the housing element 204 to the top surface 214 and/or bottom surface 218 of the substrate 210. As such, contact point(s) 216*a-b* may be correspondingly located on the top surface 214, bottom surface 218, and/or other portions of the substrate 210 depending on the orientation of the connector pin(s) 220*a-b*.

FIG. 2B illustrates another embodiment related to coupling the electronic receptacle 120 to the substrate 210. As illustrated in FIG. 2B, the electronic receptacle 120 may be positioned such that the top portion 206 of the housing element 204 may be disposed between the top surface 214 and the bottom surface 218 of the substrate 210. In addition, the bottom portion 208 of the housing element 204 may extend below the bottom surface 218 of the substrate 210. Furthermore, the connector pin(s) 220*a-b* may extend from the side portion(s) 212*a-b* of the housing element 204 to the contact point(s) 216*a-b* on the bottom surface 218 of the substrate 210.

Alternatively, the electronic receptacle 120 may be positioned on the substrate 210 such that the top portion 206 of the housing element 204 may extend above the top surface 214 of the substrate 210, and the bottom portion 208 of the housing element 204 may be disposed between the top surface 214 and the bottom surface 218 of the substrate 210. In such an embodiment, contact point(s) 216*a-b* may be coupled to the top surface 214 of the substrate 210, and connector pin(s) 220*a-b* may extend from the side portion(s) 212 of the housing element 204 to the contact point(s) 216*a-b* on the top surface 214 of the substrate 210.

Figure 3:
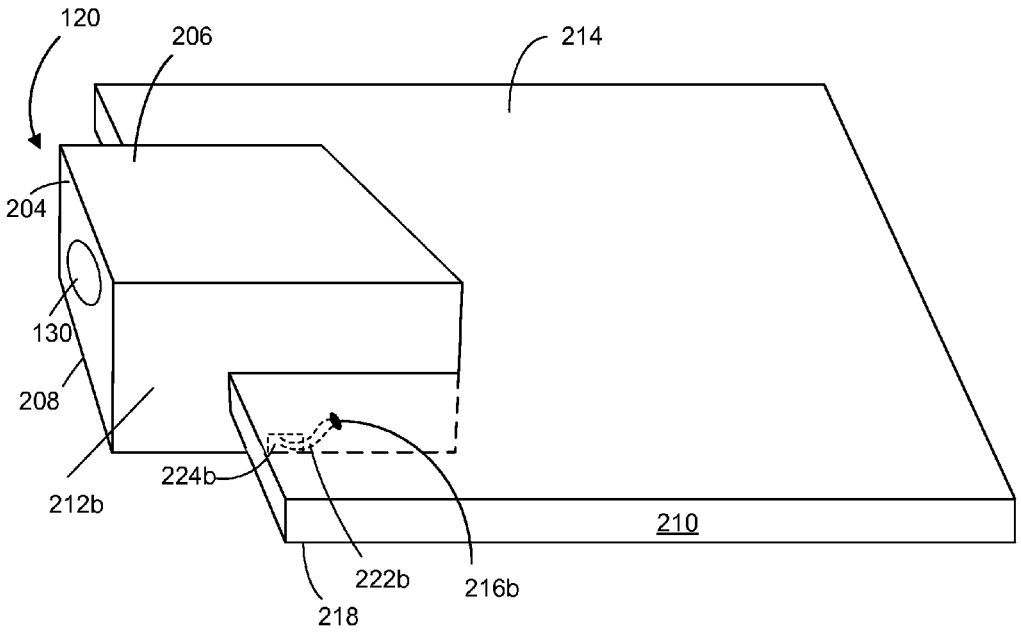
FIG. 3 shows a side-view of an electronic receptacle according to one or more example embodiments.

FIG. 2C and FIG. 3 should be viewed in conjunction with each other. FIG. 2C provides another front-view illustration of the electronic receptacle 120 and the substrate 210 according to one or more embodiments of the present disclosure. FIG. 3 provides a side-view depiction corresponding to the illustration in FIG. 2C. According to the depiction in FIG. 2C and FIG. 3, the housing element 204 of the electronic receptacle 120 may define one or more apertures 224*a-b* through which the connector pin(s) 220*a-b* may be slotted. In other words, the apertures 224*a-b* may receive the connector pin(s) 220*a-b* and substantially limit the movement of the connector pin(s) 220*a-b* within the aperture.

In embodiments where the connector pins(s) 220*a-b* are spring contacts, the springs in the connector pin(s) 220*a-b* may be loaded such that the connector pin(s) 220*a-b* may be substantially secured by experiencing the limited movement while slotted within the apertures 224*a-b* and experiencing the force exerted by the substrate 210 on the connector pin(s) 220*a-b*. For example, as illustrated in FIG. 2C, the connector pin(s) 220*a-b* may be substantially secured by the downward force exerted by the substrate 210 on the connector pin(s) 220*a-b* and by being slotted within the apertures 224*a-b*. As such, the apertures 224*a-b* may in some embodiments be employed in lieu of fastening elements 222, such as those illustrated in FIG. 2A, since the connector pin(s) 220*a-b* may be relatively secure within the apertures 224*a-b*. Furthermore, while FIG. 2C illustrates the apertures 224*a-b* as being located on the side portions 212*a-b* of the housing element 204 and below the bottom surface 218 of the printed circuit board, it should be understood that any number of apertures 224*a-b* may be located at any portions (e.g., top or bottom) of the housing element 204.

Figure 4:
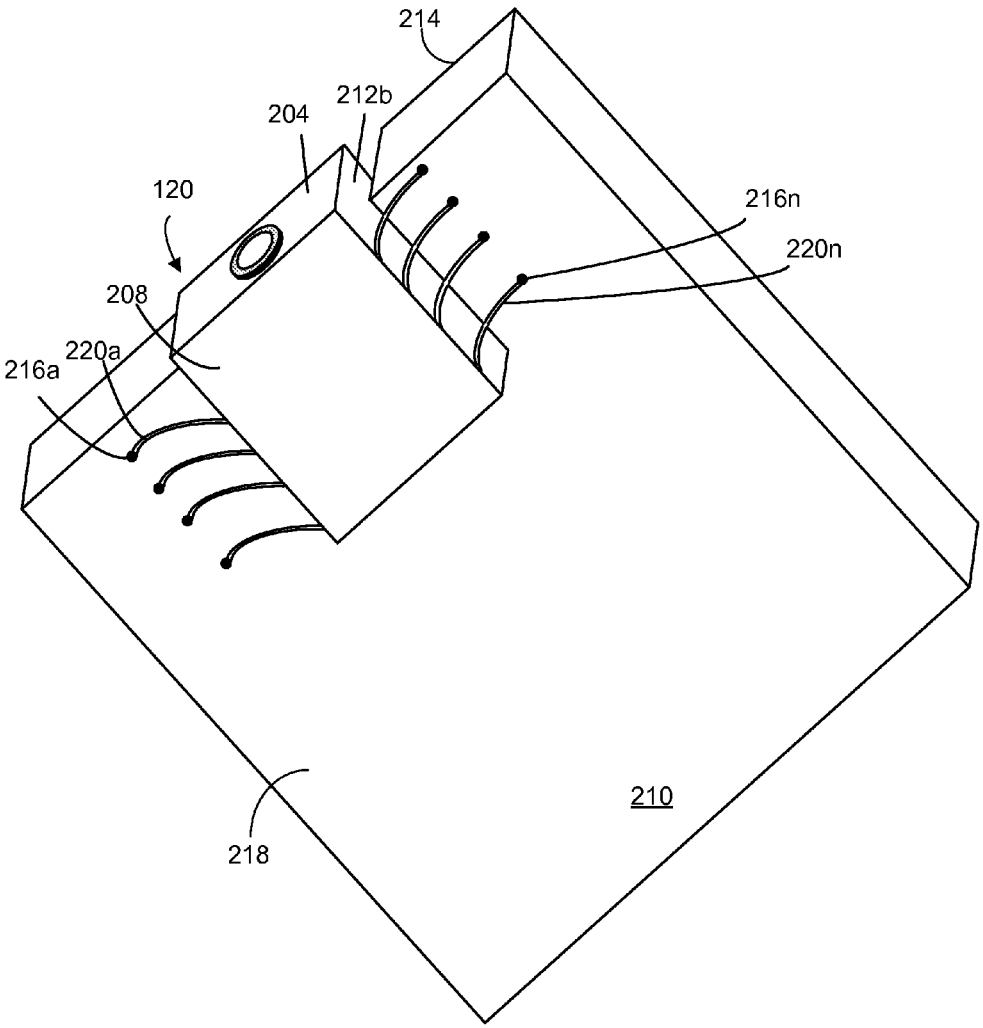
FIG. 4 shows a bottom-view of an electronic receptacle according to one or more example embodiments.

FIG. 4 provides a bottom-view illustration corresponding to the front-view illustration in FIG. 2A. FIG. 4 illustrates eight-connector pins 220*a-n* providing electrical couplings between the electronic receptacle 120 and the substrate 210; however, it should be noted that any number of connector pins 220*a-n* are possible. Furthermore, while FIG. 4 depicts the connector pins 220*a-n* as being coupled to either side portions 212*a-b* of the housing element 204, it should be understood that the connector pins 220*a-n* can be located at any point on the housing element 204 in any configuration.

Figure 5:
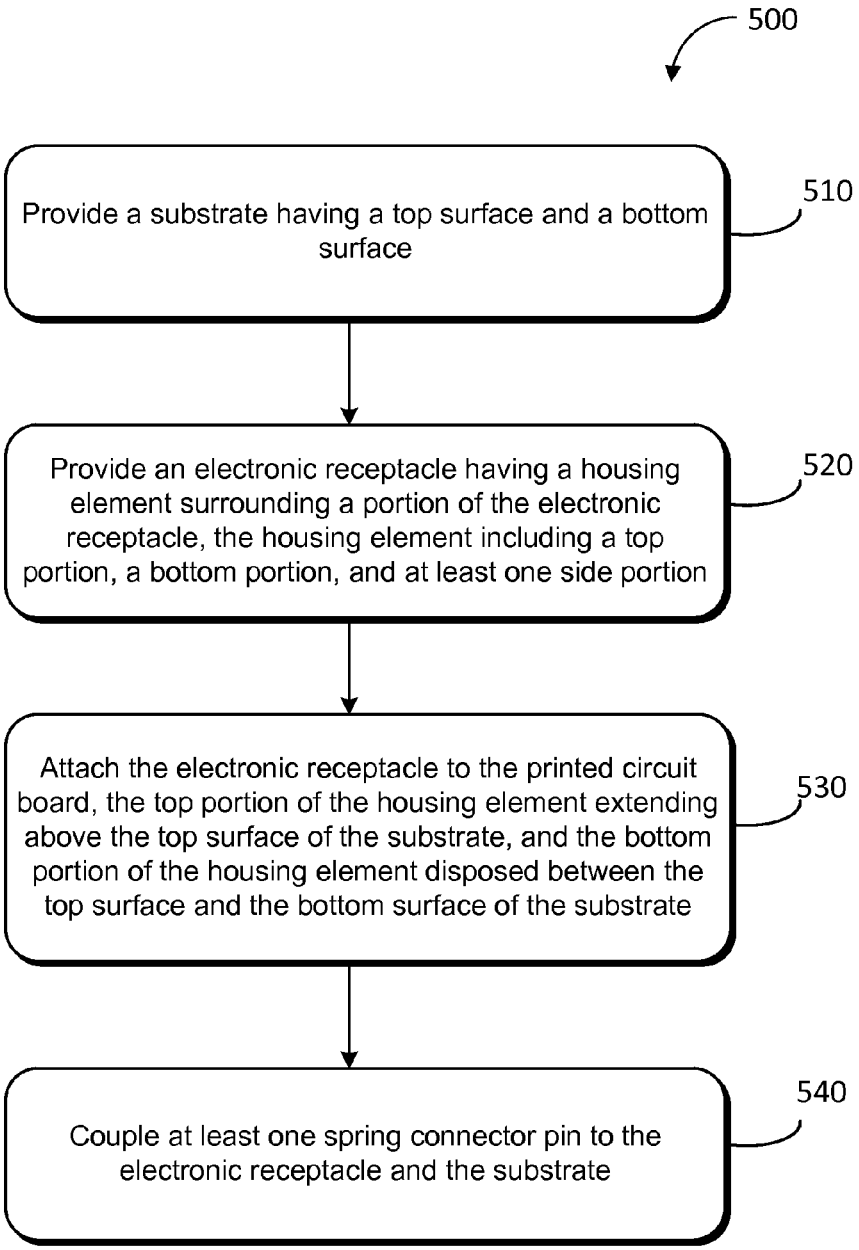
FIG. 5 shows a flow diagram of a method for assembling an electronic receptacle coupled to a device according to one or more example embodiments.

FIG. 5 depicts a flow diagram illustrating a method 500 for assembling a device according to one or more embodiments of the present disclosure. For example, the method 500 may describe coupling an electronic receptacle 120 to a device 110 and/or to a substrate 210 associated with the device 110.

In one embodiment, the method may begin in block 510 where a substrate 210 having a top portion and a bottom portion is provided (e.g., top/upper surface 214 and bottom/lower surface 218).

In block 520, an electronic receptacle 120 having a housing element 204 surrounding a portion of the electronic receptacle 120 may be provided. For example, the housing element may include a top portion 206, a bottom portion 208, and at least one side portion 212.

In block 530, the electronic receptacle 120 may be attached to the substrate 210 such that the housing element 204 is mid-mounted to the substrate 210. For example, the top portion 206 of the housing element 204 may be disposed between the top surface 214 and the bottom surface 218 of the substrate 210. Additionally, the bottom portion 208 of the housing element 204 may extend below the bottom surface 218 of the substrate 210. Such a configuration may correspond to the illustration in FIG. 2B.

Additionally, in other embodiments, the electronic receptacle 120 may be attached to the substrate 210 such that the housing element 204 extends above the top surface 214 and below the bottom surface 218 of the substrate 210, such as in FIG. 2A, 2C. Alternatively, the bottom portion 208 of the housing element 204 may be disposed between the top surface 214 and bottom surface 218 of the substrate 210, while the top portion 206 of the housing element 204 may extend above the top surface 214 of the substrate 210.

In block 540, at least one spring contact pin 220 may be coupled to the electronic receptacle 120 and the substrate 210. For example, the connector pin 220 may extend from a side portion 212*a-b* of the housing element 204 to one or more contact points 216*a-b* on the top surface 214 and/or bottom surface 218 of the substrate 210. To this end, the connector pin 220 may be fastened to the side portion 212*a-b* via one or more fastening elements 222*a-b*. Alternatively, the connector pin 220 may be slotted through one or more apertures 224*a-b* in the side portion(s) 212*a-b*.

CONCLUSION

References to "one embodiment," "an embodiment," "example embodiment," "various embodiments," and so forth indicate that the embodiment(s) of the present disclosure so described may include a particular feature, structure, or characteristic, but not every embodiment necessarily includes the particular feature, structure, or characteristic. Furthermore, repeated use of the phrase "in one embodiment" does not necessarily refer to the same embodiment, although it may.

As used herein, unless otherwise specified, the use of the ordinal adjectives "first," "second," "third," etc., to describe a common object merely indicates that different instances of like objects are being referred to and are not intended to imply that the objects so described must be in a given sequence, either temporally, spatially, in ranking, or in any other manner.

As used herein, unless otherwise specified, the term "user device" and/or "device" refers, in general, to an electronic communication device, both wired and wireless, and more particularly to one or more of the following: a portable electronic device, a telephone (e.g., cellular phone, smart phone), a computer (e.g., laptop computer, tablet computer, desktop computer, wearable computer), a portable media player, a personal digital assistant (PDA), or any other electronic device having a networked capability.

The operations and processes described and shown above may be carried out or performed in any suitable order as desired in various implementations. Additionally, in certain implementations, at least a portion of the operations may be carried out in parallel. Furthermore, in certain implementations, less than or more than the operations described may be performed.

Certain aspects of the disclosure are described above with reference to block and flow diagrams of systems, methods, apparatuses, and/or computer program products according to various implementations. It will be understood that one or more blocks of the block diagrams and flow diagrams, and combinations of blocks in the block diagrams and the flow diagrams, respectively, can be implemented by computer-executable program instructions. Likewise, some blocks of the block diagrams and flow diagrams may not necessarily need to be performed in the order presented, or may not necessarily need to be performed at all, according to some implementations.

These computer-executable program instructions may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or steps for performing the specified functions and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A device, comprising:

a printed circuit board having a top surface, a bottom surface, and an opening; and an audio jack coupled to the printed circuit board using at least one spring connector, the audio jack comprising a housing element for housing at least a portion of the audio jack and an audio jack opening configured to receive an audio component, the housing element including at least one side portion and an outward facing portion facing outward from the opening of the printed circuit board and perpendicular to the at least one side portion, wherein the audio jack opening is positioned on the outward facing portion, wherein the opening of the printed circuit board is to receive therein at least one portion of the housing element, and wherein:

a first portion of the housing element extends above the top surface of the printed circuit board, and a second portion of the housing element extends below the bottom surface of the printed circuit board, the at least one spring connector extends from the at least one side portion of the housing element to the printed circuit board, the at least one spring connector does not extend above the housing element, and the at least one spring connector does not extend below the housing element.

2. The device of claim 1, wherein the printed circuit board comprises at least one electrically-conductive contact point to receive the at least one connector pin to facilitate electrical communication, via the at least one connector pin, between the audio jack and the printed circuit board.

3. The device of claim 2, wherein the at least one spring connector is electrically coupled to the at least one electrically conductive contact point when the at least one portion of the housing element is inserted into the opening of the printed circuit board.

4. The device of claim 1, wherein the at least one spring connector is configured to provide an opposable force against the top surface or the bottom surface of the printed circuit board, to maintain electrical contact therewith, when the at least one portion of the housing element is inserted into the opening of the printed circuit board.

5. The device of claim 1, wherein the at least one side portion of the housing element defines an opening or slot to receive the at least one spring connector.

6. A device, comprising:

an electronic receptacle defining a receptacle opening to receive an electronic connector component;

a substrate component having an upper surface, a lower surface, and an opening, the opening to receive therein the electronic receptacle;

a housing element housing at least a portion of the electronic receptacle, wherein:

a first surface of the housing element is disposed between the upper surface and the lower surface of the substrate component, and a second surface of the housing element extends above the upper surface of the substrate component or extends below the lower surface of the substrate component;

the receptacle opening is positioned about an outward facing surface of the housing element, the outward facing surface facing away from the opening of the substrate component; and at least one connector pin coupled to the housing element and the substrate component, the at least one connector pin substantially secure via force exerted on the at least one connector pin by the substrate component.

7. The device of claim 6, wherein the electronic receptacle is an audio jack comprising a blind hole.

8. The device of claim 6, wherein the substrate component is a printed circuit board.

9. The device of claim 8, wherein the opening of the substrate component is configured to receive the electronic receptacle such that when the electronic receptacle is inserted into the opening, the at least one connector pin is electrically coupled to the substrate component.

10. The device of claim 6, wherein the substrate component comprises at least one electrically-conductive contact pad, to receive the at least one connector pin, and to facilitate electrical communication, via the at least one connector pin, between the electronic receptacle and the substrate component.

11. The device of claim 6, wherein the at least one connector pin does not extend above the housing element and does not extend below the housing element.

12. The device of claim 6, wherein the at least one connector pin comprises at least one spring contact.

13. The device of claim 12, wherein the at least one spring contact is configured to provide an opposable force against the upper surface or the lower surface of the substrate component, to maintain electrical contact therewith, when the electronic receptacle is inserted into the opening of the substrate component.

14. A method for assembling a device, comprising:

providing a substrate having a top surface, a bottom surface, and an opening;

providing an electronic receptacle having a housing element housing at least a portion of the electronic receptacle, the housing element comprising a top portion, a bottom portion, an outward facing portion, and at least one side portion;

attaching the electronic receptacle to the substrate, the top portion of the housing element extending above the top surface of the substrate, and the bottom portion of the housing element disposed between the top surface and the bottom surface of the substrate, such that the outward facing portion faces away from the opening of the substrate; and coupling at least one spring contact pin to the electronic receptacle and the substrate, wherein the at least one spring contact pin does not extend above the housing element and does not extend below the housing element.

15. The method of claim 14, wherein the electronic receptacle is an audio jack comprising a blind hole.

16. The method of claim 14, wherein the substrate is a printed circuit board.

17. The method of claim 14, wherein the at least one side portion of the housing element defines an opening or slot to receive the at least one spring contact pin.

18. The method of claim 14, wherein the substrate comprises at least one electrically-conductive contact pad, to receive the at least one spring contact pin, and to facilitate electrical communication, via the at least one spring contact pin, between the electronic receptacle and the substrate.

19. The method of claim 18, wherein attaching the electronic receptacle to the substrate comprises inserting the electronic receptacle into the opening of the substrate such that the at least one spring contact pin is electrically coupled to the electrically-conductive contact pad.

20. The method of claim 14, wherein the at least one spring contact pin is configured to provide an opposable force against the top surface or the bottom surface of the substrate, to maintain electrical contact therewith, when the electronic receptacle is inserted into the opening of the substrate.

* * * * *